US006106019A

United States Patent [19]

Such

[11] Patent Number: 6,106,019

[45] Date of Patent: Aug. 22, 2000

[54] VALUE STAMPS PROMOTION KIT WITH BREAK-OPEN STAMPS

[75] Inventor: David A. Such, Great Falls, Mont.

[73] Assignee: D. Allan Such & Associates, Inc., Great Falls, Mont.

[21] Appl. No.: 09/197,174

[22] Filed: Nov. 20, 1998

Related U.S. Application Data

[60] Provisional application No. 60/067,204, Dec. 1, 1997.

[51] Int. Cl.[7] ..... B42D 15/00

[52] U.S. Cl. ..... 283/51; 283/53; 283/71; 283/101; 283/105

[58] Field of Search ..... 83/51, 53, 71, 83/101, 105

[56] References Cited

U.S. PATENT DOCUMENTS

| | | | |
|---|---|---|---|
| 3,421,239 | 1/1969 | Smith | 283/101 |
| 3,718,348 | 2/1973 | Bellanca | 283/101 |
| 5,106,090 | 4/1992 | Greenwood | 283/52 |
| 5,839,763 | 11/1998 | McCannel | 283/107 |
| 5,865,470 | 2/1999 | Thompson | 283/51 |

*Primary Examiner*—Andrea L. Pitts
*Assistant Examiner*—Mark T. Henderson
*Attorney, Agent, or Firm*—Webb Zisenheim Logsdon Orkin & Hanson, P.C.

[57] ABSTRACT

A value stamp promotion kit comprises a plurality of value stamps and at least one value book to which the stamps can be affixed. The value stamps are packaged in a break-open ticked having a tab removable by tearing it away from the ticket and having an adhesive thereon enabling it to be affixed to the value book.

4 Claims, 1 Drawing Sheet

VALUE STAMPS PROMOTION KIT WITH BREAK-OPEN STAMPS

RELATED APPLICATION

This application claims the benefit of United States Provisional Patent Application Ser. No. 60/067,204, filed Dec. 1, 1997.

BACKGROUND OF THE INVENTION

This invention pertains to sales promotion through the use of redeemable value stamps. The generic sales promotion program, such as those known as S & H Green Stamps and Eagle Stamps, is known. This application is directed to a novel variation of the value stamp promotion program wherein the value stamps themselves are delivered in a break-open package that increases the way in which participants are encouraged to purchase products from program sponsors.

Program sponsors, that is, merchants sponsoring a value stamp program, distribute value stamps based upon the total value of purchases. The customer is given a value book with indicated spaces for the customer to paste the value stamps. When the book is filled, the customer is entitled to use the assigned value of the book as part of the purchase price of additional merchandise. So far, this description is of the generic value stamp program.

SUMMARY OF THE INVENTION

To make this value stamp program capable of being used by one or only a few merchants and to increase the customer excitement and participation in the program, the means for delivering the value stamp is much different than with the sheets of perforated stamps previously used. Each stamp is individually packaged. Additionally, each stamp will be issued only for larger increments of the purchase price of the goods, say, in $5.00 increments.

The stamp is supplied to the sponsor in break-open packages. The break-open packages are made of two layers of paperboard of varying thicknesses. One layer is die cut on four sides defining a border and a tear-open tab. The border of the second layer is permanently affixed to the first layer. Such constructs are sometimes called break-open or pull tabs. Break-open or pull tab structures have been used for lottery-type games but never for the delivery of value stamps. The first (exposed) side of the first layer of the break-open package will have graphics and words printed thereon identifying the sponsor or sponsors of the value stamp program. The back (unopened) side of the second layer will contain a message to remove the tab and paste it in a value book. The back preferably will have difficult-to-counterfeit engraving thereon. The inside (exposed upon tearing open the tab) of the first layer may have an optional message, for example, "Thank You" or "Receive an Additional Stamp". The inside of the tab will have security protection included thereon so that it cannot be forged or altered. The inside of the stamp may also have optional indicia thereon, such as "VALUE". The inside of the tab will also have a wet or lick adhesive thereon or may have a no wet adhesive which, because of a special surface on the inside of the first layer, will release from the package but will adhere to the value book.

THE DRAWINGS

Further features and other objects and advantages will become clear from the following detailed description made with reference to the drawings in which.

DESCRIPTION OF THE PREFERRED EMBODIMENT

Figure 1A:
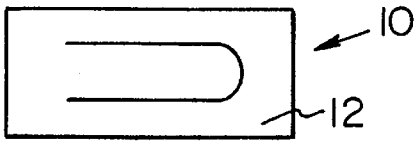
FIG. 1 is a perspective view of a value book.
Figure 1B:
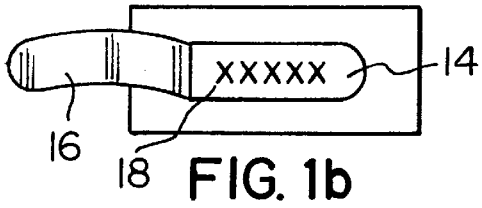

Referring to FIG. 1, there is shown an open value book 10 with identification 11 of the sponsor at the top of each page 12 and a grid printed on each page for aligning the insertion or paste in of value stamps. As indicated, value stamps 20 have been pasted into the book.

Figure 3:
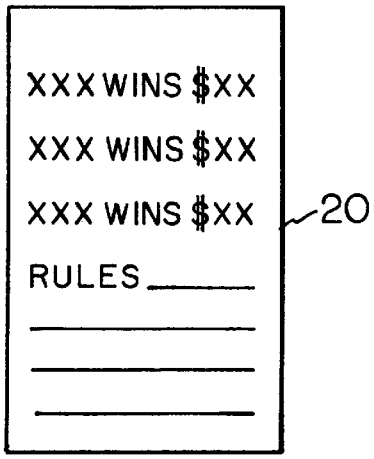
FIGS. 2 and 3 are alternate views of the front side of the first layer of a break-open package according to this invention.
Figure 2:
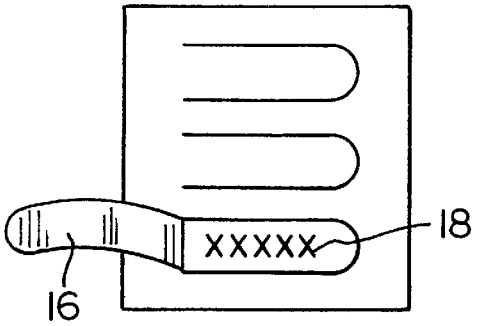

The break-open package 21 for value stamps is illustrated in FIGS. 2, 3, 4 and 5. FIGS. 2 and 3 illustrate optional graphics and words to identify and promote the sponsor.

Figure 4:
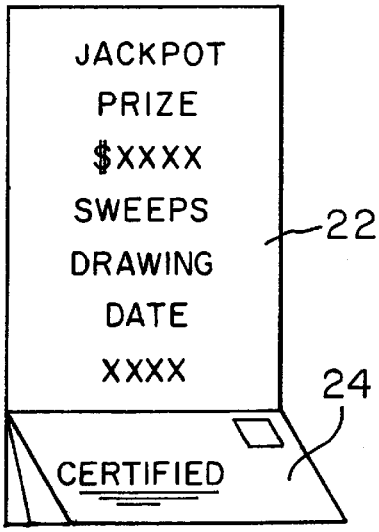
FIG. 4 is the back side of the second layer of a break-open package according to this invention not opened.
Figure 5:
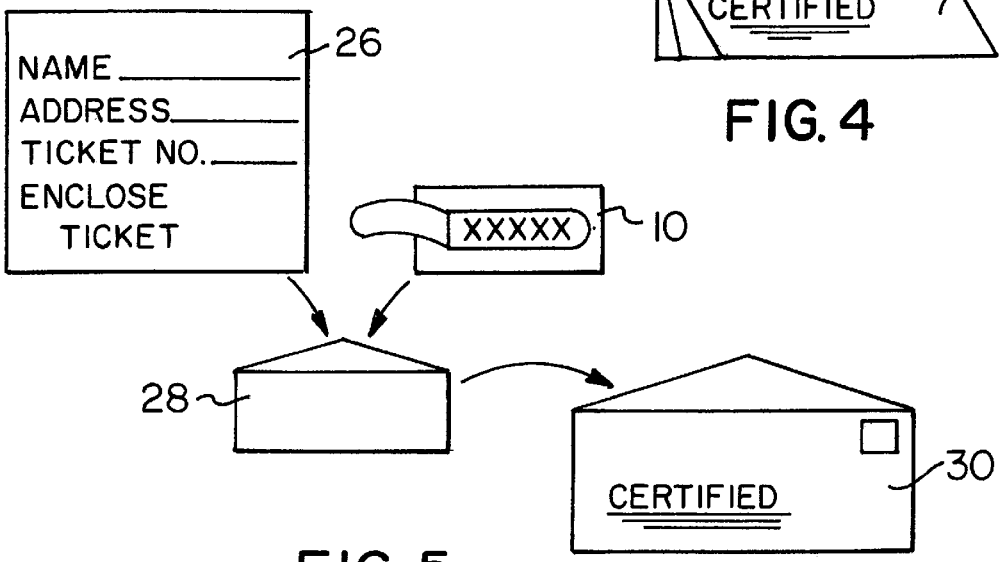
FIG. 5 is the back side of the second layer of a break-open package according to this invention which has been opened.

FIG. 4 shows the back side of the break-open package and the die cut perforations 22 that enable the removal of the tab. When the package is opened, the tab is pulled up and the back side is exposed as shown in FIG. 5. Preferably, this side will have a wet and stick adhesive. It would be possible, however, to place the wet and stick adhesive on the outside of the tab.

Having thus described my invention with the detail and particularity required by the Patent Laws, what is desired protected by Letters Patent is set forth in the following claims.

What is claimed is:

1. A value stamp promotion kit comprising:

a plurality of value stamps; and at least one value book to which the stamps can be affixed and wherein the value stamps are packaged in a break-open ticket comprised of a first layer and a second layer, said second layer having a border frangibly attached to a tab, the border of said second layer permanently affixed to said first layer, said tab being removable by tearing it away from said first layer to expose a tab inside surface and a second layer inside surface, said tab having an adhesive thereon enabling it to be affixed to the value book and wherein said tab, prior to being removed, conceals indicia indicating whether or not said value stamp entitles a holder of said stamp to an additional award beyond that of the value stamp itself, wherein said indicia is marked upon one of either the tab inside surface or the second layer inside surface.

2. The value stamp promotion kit according to claim 1, wherein the adhesive on the tab is a wet and stick adhesive.

3. The value stamp promotion kit according to claim 1, wherein the adhesive on the tab does not require wetting and is especially prepared to release the tab.

4. The value stamp promotion kit according to claim 1, wherein the adhesive of the tab is unexposed prior to the tab being removed from the break-open ticket.

* * * * *

UNITED STATES PATENT AND TRADEMARK OFFICE

CERTIFICATE OF CORRECTION

PATENT NO. : 6,106,019

DATED : August 22, 2000

INVENTOR(S) : David A. Such

It is certified that error appears in the above-identified patent and that said Letters Patent is hereby corrected as shown below:

In the Drawings: Substitute the attached set of drawings for those printed in the patent.

Signed and Sealed this

First Day of May, 2001

*Attest:*

Nicholas P. Godici

NICHOLAS P. GODICI

*Attesting Officer*

*Acting Director of the United States Patent and Trademark Office*